US010603810B2

(12) United States Patent
Rodriguez

(10) Patent No.: US 10,603,810 B2
(45) Date of Patent: Mar. 31, 2020

(54) MOLDING SYSTEM AND METHOD OF USE

(71) Applicant: Edgar Rodriguez, Odessa, TX (US)

(72) Inventor: Edgar Rodriguez, Odessa, TX (US)

( * ) Notice: Subject to any disclaimer, the term of this patent is extended or adjusted under 35 U.S.C. 154(b) by 359 days.

(21) Appl. No.: 15/711,923

(22) Filed: Sep. 21, 2017

(65) Prior Publication Data

US 2018/0079103 A1 Mar. 22, 2018

Related U.S. Application Data

(60) Provisional application No. 62/397,425, filed on Sep. 21, 2016.

(51) Int. Cl.

| | |
|---|---|
| ***B27C 7/04*** | (2006.01) |
| ***B27M 3/08*** | (2006.01) |
| *B27M 3/00* | (2006.01) |

(52) U.S. Cl.

CPC ..... *B27C 7/04* (2013.01); *B27M 3/08* (2013.01); *B27M 3/0013* (2013.01)

(58) Field of Classification Search

CPC .. B27C 7/04; B27C 7/06; B27M 3/08; B27M 3/0013

See application file for complete search history.

(56) References Cited

U.S. PATENT DOCUMENTS

| | | | | |
|---|---|---|---|---|
| 9,623,526 | B2 * | 4/2017 | Perez | B23Q 1/76 |
| 2016/0184953 | A1 * | 6/2016 | Harder | B23Q 17/2409 348/86 |

* cited by examiner

*Primary Examiner* — Matthew Katcoff
(74) *Attorney, Agent, or Firm* — Shannon L Warren

(57) ABSTRACT

A jig system for trimming of a one or more uncut boards. Said jig system comprises a two halves, a bracket mating system, a one or more male portions, a one or more female sockets, a first end, a second end, a first lathe adapter assembly, and a second lathe adapter assembly. Said two halves comprise a first half and a second half. Said two halves are configured to selectively mate with one another. Said two halves comprises an assembled configuration and a disassembled configuration. Said assembled configuration comprises said two halves mated with one another. Said disassembled configuration comprise said two halves detached from one another. Said two halves comprise an angled irons having a substantially L-shape. Said two halves comprise a bend, an inner sides, an outer sides, a first planar portion and a second planar portion.

12 Claims, 16 Drawing Sheets

PRIOR ART

MOLDING SYSTEM AND METHOD OF USE

CROSS-REFERENCE TO RELATED APPLICATIONS

This application claims benefit to U.S. patent application Ser. No. 62/397,425 filed on Sep. 21, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

None of the known inventions and patents, taken either singularly or in combination, is seen to describe the instant disclosure as claimed.

BRIEF SUMMARY OF THE INVENTION

A jig system for trimming of a one or more uncut boards. Said jig system comprises a two halves, a bracket mating system, a one or more male portions, a one or more female sockets, a first end, a second end, a first lathe adapter assembly, and a second lathe adapter assembly. Said two halves comprise a first half and a second half. Said two halves are configured to selectively mate with one another. Said two halves comprises an assembled configuration and a disassembled configuration. Said assembled configuration comprises said two halves mated with one another. Said disassembled configuration comprise said two halves detached from one another. Said two halves comprise an angled irons having a substantially L-shape. Said two halves comprise a bend, an inner sides, an outer sides, a first planar portion and a second planar portion. Said first planar portion joins said second planar portion at said outer sides. Said inner sides comprise faces of said first planar portion and said second planar portion proximate said bend. Said outer sides comprise faces of said first planar portion and said second planar portion opposite said inner sides. Said first half comprise said one or more male portions mounted to said inner sides. Said second half comprise said one or more female sockets mounted to said inner sides. Said outer sides is configured to selectively hold said one or more uncut boards. Said jig system is configured to selectively attach to a lathe having a head stock and a tail stock. Said jig system comprises said first lathe adapter assembly at said first end and said second lathe adapter assembly at said second end. Said first lathe adapter assembly selectively attaches to said head stock of said lathe and said second lathe adapter assembly selectively attaches to said tail stock of said lathe.

A jig system for trimming of a one or more uncut boards. a first lathe adapter assembly comprises a bolt having an eye at a second end of said jig system. Said first lathe adapter assembly comprises a bolt in a sleeve. Said sleeve is attached to an inner sides of a first half. Said first lathe adapter assembly further comprises a jaw chuck ring. Said bolt comprises a head and a threading. Said bolt is rotateably held within a portion of said sleeve. Said jaw chuck ring comprises an inner threading. Said inner threading of said jaw chuck ring selectively attaches to said threading of said bolt. A lathe comprises a jaw chuck. Said jaw chuck comprises a one or more jaws. Said jaw chuck ring comprise a one or more jaw lips. Said jaw chuck ring selectively attaches to said jaw chuck by: sliding a portion of said jaw chuck into a portion of said jaw chuck ring, expanding said one or more jaws into a portion of said one or more jaw lips, holding said jaw chuck ring with said one or more jaws. Assembling said jig system into a disassembled configuration comprises aligning a portion of a one or more male portions with a portion of a one or more female sockets, sliding a portion of said one or more male portions into said one or more female sockets, and securing said first half to a second half.

A method of using a jig system to trim a one or more uncut boards comprising: attaching said one or more uncut boards to said jig system. Rotating said jig system on a lathe. Trimming said one or more uncut boards into a one or more cut boards. A first lathe adapter assembly comprises a bolt having an eye at a second end of said jig system. Said first lathe adapter assembly comprises a bolt in a sleeve. Said sleeve is attached to an inner sides of a first half. Said first lathe adapter assembly further comprises a jaw chuck ring. Said bolt comprises a head and a threading. Said bolt is rotateably held within a portion of said sleeve. Said jaw chuck ring comprises an inner threading. Said inner threading of said jaw chuck ring selectively attaches to said threading of said bolt. Said lathe comprises a jaw chuck. Said jaw chuck comprises a one or more jaws. Said jaw chuck ring comprise a one or more jaw lips. Said jaw chuck ring selectively attaches to said jaw chuck by: sliding a portion of said jaw chuck into a portion of said jaw chuck ring, expanding said one or more jaws into a portion of said one or more jaw lips, holding said jaw chuck ring with said one or more jaws. Assembling said jig system into a disassembled configuration comprises aligning a portion of a one or more male portions with a portion of a one or more female sockets, sliding a portion of said one or more male portions into said one or more female sockets, and securing said first half to a second half.

DETAILED DESCRIPTION OF THE INVENTION

Figure 1A:
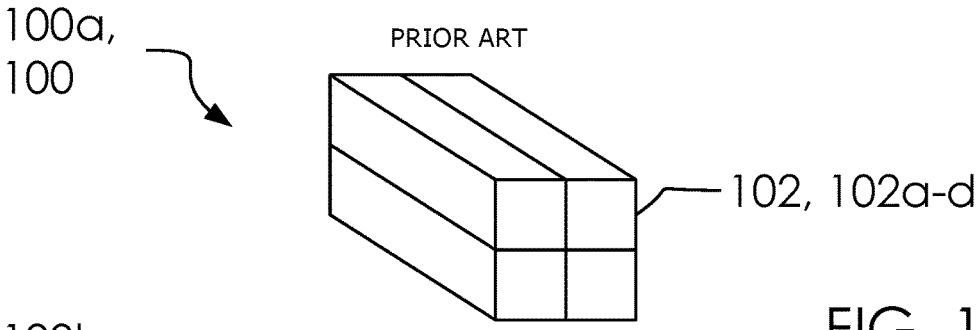
FIG. 1A illustrates a perspective top side view of a first prior art steps 100*a*.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers'specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a one or more prior art steps 100
a first prior art steps 100*a*
a second prior art steps 100*b*
a third prior art steps 100*c*
a fourth prior art steps 100*d*
a fifth prior art steps 100*e*
a one or more uncut blocks 102
a first uncut block 102*a*
a second uncut block 102*b*
a third uncut block 102*c*
a fourth uncut block 102*d*
a one or more rope cut blocks 104
a first rope cut block 104*a*
a second rope cut block 104*b*
a third rope cut block 104*c*
a fourth rope cut block 104*d*
a one or more trimmed uncut blocks 106
a first trimmed uncut block 106*a*
a second trimmed uncut block 106*b*
a third trimmed uncut block 106*c*
a fourth trimmed uncut block 106*d*
a one or more wasted portions 108
a first wasted portion 108*a*
a second wasted portion 108*b*
a third wasted portion 108*c*
a fourth wasted portion 108*d*
a carved pattern 110
a transition piece 200
a gap 202
a lathe 300
a head stock 302
a basket 304
a tail stock 306
an adjustment wheel 400
a jig system 500
a two halves 502
a first half 502*a*
a second half 502*b*
a one or more male portions 504
a first male portion 504*a*
a second male portion 504*b*
a third male portion 504*c*
a fourth male portion 504*d*
a one or more female sockets 506
a first female socket 506*a*
a second female socket 506*b*
a third female socket 506*c*
a fourth female socket 506*d*
a plurality of screws 508
a bracket mating system 510
a bolt 512
a threaded sleeve 514
a bolt 516
a sleeve 518
a jaw chuck ring 520
an angled irons 522
a first angled iron 522*a*
a second angled iron 522*b*
a bend 524
an inner sides 526
an outer sides 528
a first planar portion 530
a second planar portion 532
a disassembled configuration 534
an assembled configuration 600
a first end 602
a second end 604
an outer body 606
a first lathe adapter assembly 608
a second lathe adapter assembly 610 a central rotating axis 612
a jig with boards 700
a one or more uncut boards 702
a first uncut board 702*a*
a second uncut board 702*b*
a third uncut board 702*c*
a fourth uncut board 702*d*
an eye 704
a four sides 706
a top 706*a*
a first side 706*b*
a second side 706*c*
a bottom 706*d*
a length 902
a width 904
a diameter 906
a collar 1002
a female threading 1004
a male threading 1006
a head 1008
a center axis 1010
a separated view 1100*a*
an aligned view 1100*b*
an attached view 1100*c*
a first washer 1102
a second washer 1104
a one or more welds 1106
a first weld 1106*a*
a second weld 1106*b*
a third weld 1106*c*
a head 1200
a threading 1202
an inner threading 1204
a detached view 1300*a*
an attached view 1300*b*
a threaded socket 1302
a jaw chuck 1304
a one or more jaws 1306
a first jaw 1306*a*
a second jaw 1306*b*
a one or more jaw lips 1308
a first jaw lip 1308*a*
a second jaw lip 1308*b*
a jig with cut boards 1400
a one or more cut boards 1402
a first cut board 1402*a*
a second cut board 1402*b*
a third cut board 1402*c*
a fourth cut board 1402*d*

FIG. 1A illustrates a perspective top side view of a first prior art steps 100*a*.

Figure 1B:
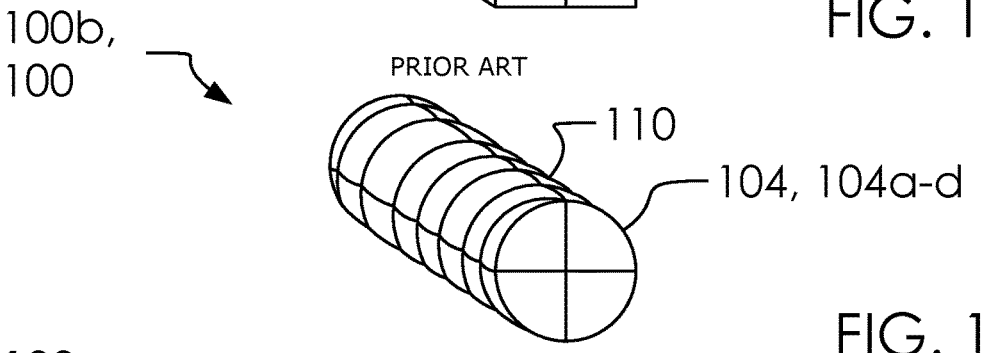
FIG. 1B illustrates a perspective top side view of a second prior art steps 100*b*.

FIG. 1B illustrates a perspective top side view of a second prior art steps 100*b*.

Figure 1C:
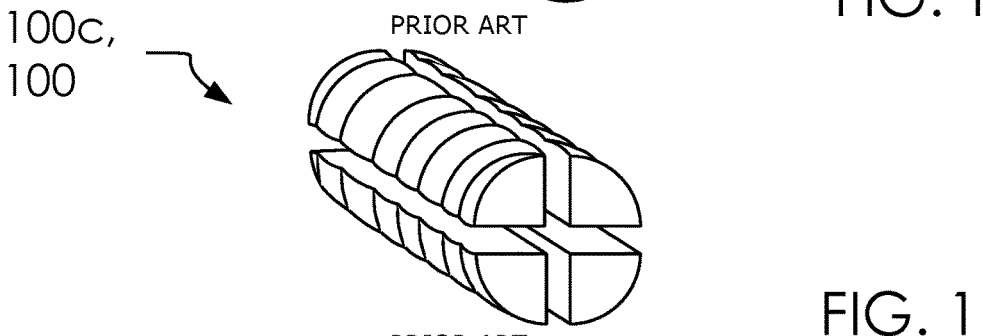
FIG. 1C illustrates a perspective top side view of a third prior art steps 100*c*.

FIG. 1C illustrates a perspective top side view of a third prior art steps 100*c*.

Figure 1D:
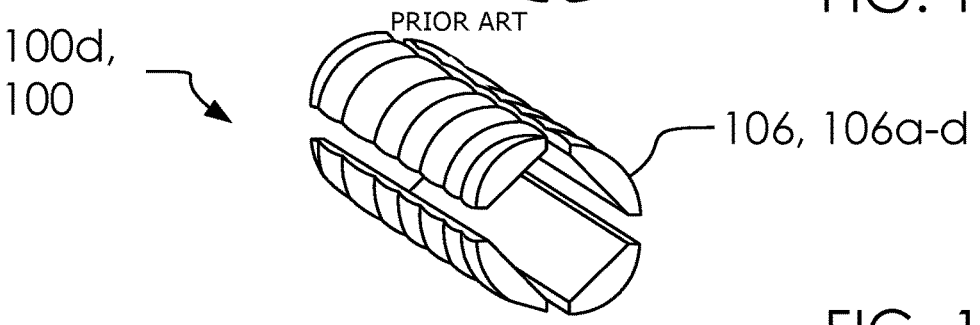
FIG. 1D illustrates a perspective top side view of a fourth prior art steps 100*d*.

FIG. 1D illustrates a perspective top side view of a fourth prior art steps 100*d*.

Figure 1E:
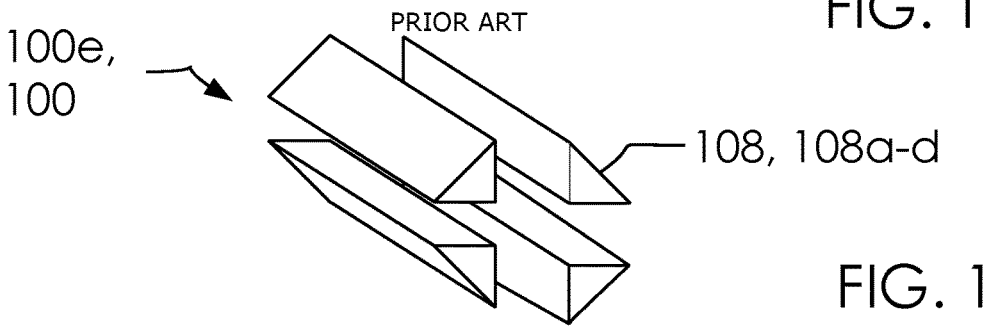
FIG. 1E illustrates a perspective top side view of a fifth prior art steps 100*e*.

FIG. 1E illustrates a perspective top side view of a fifth prior art steps 100*e*.

In one embodiment, said one or more prior art steps 100 can comprise said first prior art steps 100*a*, said second prior art steps 100*b*, said third prior art steps 100*c*, said fourth prior art steps 100*d* and said fifth prior art steps 100*e*.

In one embodiment, said one or more uncut blocks 102 can comprise said first uncut block 102*a*, said second uncut block 102*b*, said third uncut block 102*c* and said fourth uncut block 102*d*.

In one embodiment, said one or more rope cut blocks 104 can comprise said first rope cut block 104*a*, said second rope cut block 104*b*, said third rope cut block 104*c*, said fourth rope cut block 104*d* and said carved pattern 110.

In one embodiment, said one or more trimmed uncut blocks 106 can comprise said first trimmed uncut block 106*a*, said second trimmed uncut block 106*b*, said third trimmed uncut block 106*c*, said fourth trimmed uncut block 106*d* and said carved pattern 110.

In one embodiment, said one or more wasted portions 108 can comprise said first wasted portion 108*a*, said second wasted portion 108*b*, said third wasted portion 108*c* and said fourth wasted portion 108*d*.

In one embodiment, said one or more rope cut blocks 104 can be made by wasting a large amount of material, such as said one or more wasted portions 108. For example, in one case, said first prior art steps 100*a* can comprise purchasing four blocks being 4" by 4" each, sticking them together, placing them in a lathe, carving said carved pattern 110 into said one or more uncut blocks 102, breaking said one or more rope cut blocks 104 apart, and cutting said one or more wasted portions 108 from said one or more trimmed uncut blocks 106; wherein, all of said one or more wasted portions 108 are wasted material. Further wherein, said one or more uncut blocks 102 are stuck together with a paper glue method which requires a drying, curing and waiting period which is costly for workmen and artists.

One objective of the current disclosure is to eliminate the wasted represented by said one or more wasted portions 108 and the prior art approach.

Figure 2A:
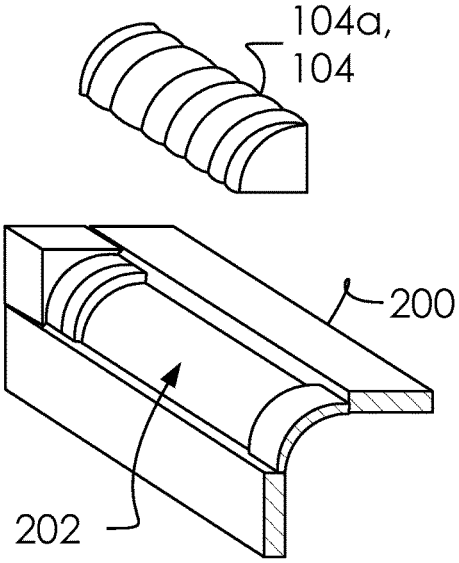
FIG. 2A PRIOR ART
FIG. 2A illustrates a perspective overview view of a transition piece 200 in an exploded view.

FIG. 2A illustrates a perspective overview view of a transition piece 200 in an exploded view.

Figure 2B:
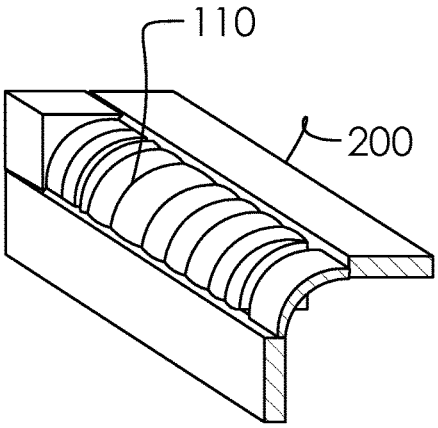
FIG. 2B PRIOR ART
FIG. 2B illustrates a perspective overview view of a transition piece 200 in an assembled view.

FIG. 2B illustrates a perspective overview view of a transition piece 200 in an assembled view.

Figure 2C:
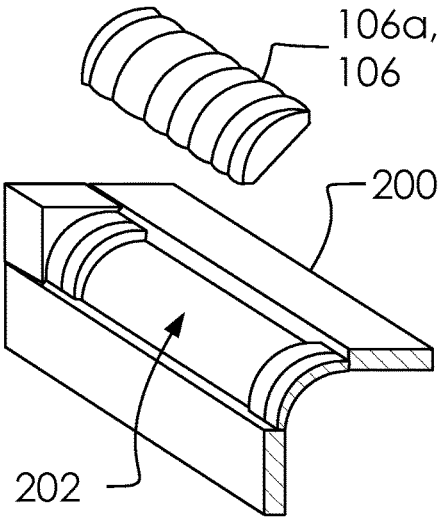
FIG. 2C PRIOR ART
FIG. 2C illustrates a perspective overview view of a transition piece 200 in an exploded view.

FIG. 2C illustrates a perspective overview view of a transition piece 200 in an exploded view.

Figure 2D:
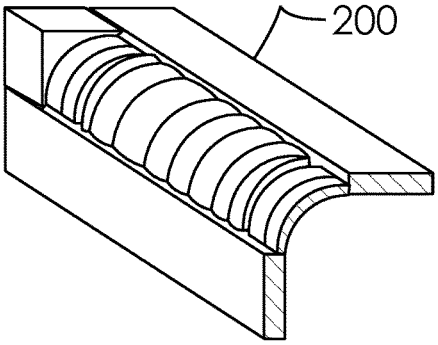
FIG. 2D illustrates a perspective overview view of a transition piece 200 in an assembled view.

FIG. 2D illustrates a perspective overview view of a transition piece 200 in an assembled view.

In one embodiment, said transition piece 200 can comprise said gap 202.

In one embodiment, said transition piece 200 can be useful as a transition piece for cabinet making or carpentry in general. In this context, said one or more uncut blocks 102 (that is rope/round moldings) can comprise a decorative strip used for finishing seams and corners or for ornamental appeal. In one embodiment, said one or more uncut blocks 102 can comprise quarter round, half round, base shoe, and half round rope molding. These moldings can be used for shelf edging, band molding, inside corner, and column wrap.

Figure 3:
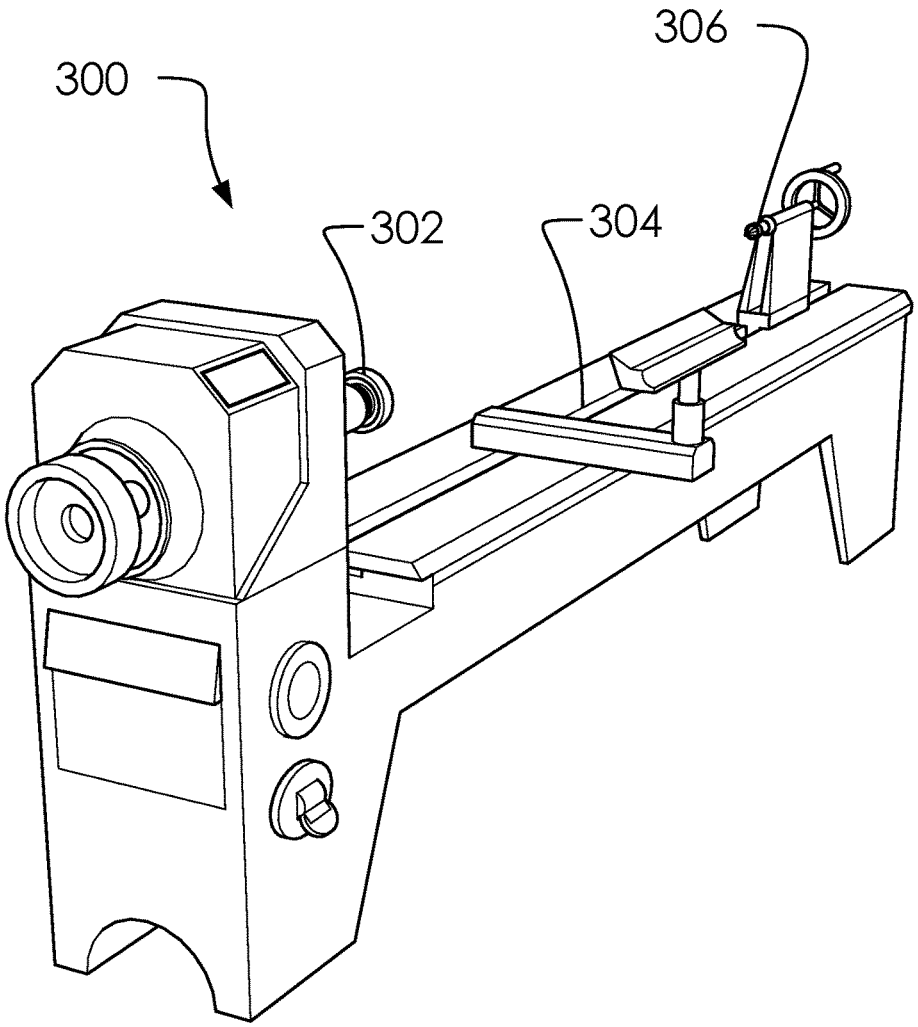
FIG. 3 illustrates a perspective overview view of a lathe 300.

FIG. 3 illustrates a perspective overview view of a lathe 300.

In one embodiment, said lathe 300 can comprise said head stock 302, said basket 304 and said tail stock 306.

In one embodiment, said lathe 300 can comprise a well-known tool in the craft and trade of carpentry. In one embodiment, said lathe 300 can comprise a 5-axis lathe and/or CNC, as is known in the art.

Said lathe 300 can be used in a field known as woodturning, which comprises a form of woodworking that is used to create wooden objects.

We quote in this section from Wikipedia in order to define the general state of the art:

"Woodturning differs from most other forms of woodworking in that the wood is moving while a stationary tool is used to cut and shape it. Many intricate shapes and designs can be made by turning wood.

"There are two distinct methods of turning wood: spindle turning and bowl or faceplate turning. Their key difference is in the orientation of the wood grain, relative to the axis of the lathe. This variation in orientation changes the tools and techniques used. In spindle turning, the grain runs lengthways along the lathe bed, as if a log was mounted in the lathe. Grain is thus always perpendicular to the direction of rotation under the tool. In bowl turning, the grain runs at right angles to the axis, as if a plank were mounted across the chuck. When a bowl blank rotates, the angle that the grain makes with the cutting tool continually changes between the easy cuts of lengthways and downwards across the grain to two places per rotation where the tool is cutting across the grain and even upwards across it. This varying grain angle limits some of the tools that may be used and requires additional skill in order to cope with it.

"In spindle turning, the wood is fixed between 2 points. The spur center digs into the wood and is powered by a motor. The other, a hard center or a live center may be a point or set of points in the tail-stock. In face plate turning, the wood is secured with screws to a faceplate or in a chuck or jig. The tail stock and a center may also be used for added support on large pieces with a faceplate. Most bowls, platters and many vessels are face plate turned, while pens, furniture legs, spindles, and some vessels are spindle turned. The method used may differ depending on the shape of the blank and the technique of the turner, and both methods may be used on the same piece.

"When wood is cut in such a way that the fiber being cut is not supported by the fiber below it, it tends to separate and tear. This "tear out" exhibits a rough, highly damaged looking surface texture and greatly reduces the value of any product exhibiting it. The direction of cut is different in spindle turning and faceplate turning because cutting in the wrong direction can cause tear out. Spindle turning cuts are made from high points toward the axis on the outside of the piece, and from the axis toward the outside when hollowing. When faceplate turning, the opposite applies."

Figure 4:
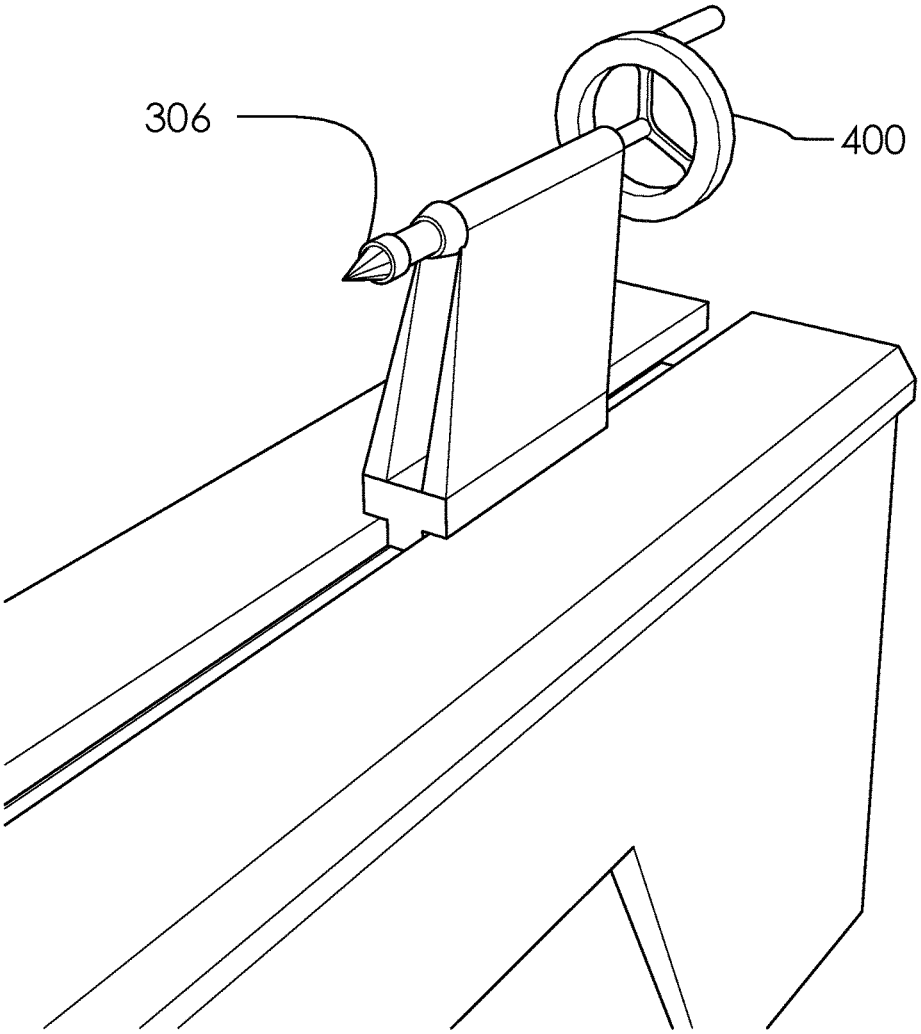
FIG. 4 illustrates a perspective second side view of a tail stock 306.

FIG. 4 illustrates a perspective second side view of a tail stock 306.

In one embodiment, said tail stock 306 can comprise said adjustment wheel 400.

Said lathe 300 can comprise said tail stock 306 for holding one end of the current system, as described below.

As is known, a distance between said tail stock 306 and said head stock 302 can be adjusted so as to selectively hold jigs and materials for treatment by said lathe 300. Said distance can be adjusted by rotating said adjustment wheel 400, as known in the art, or by means otherwise known in the art.

Figure 5:
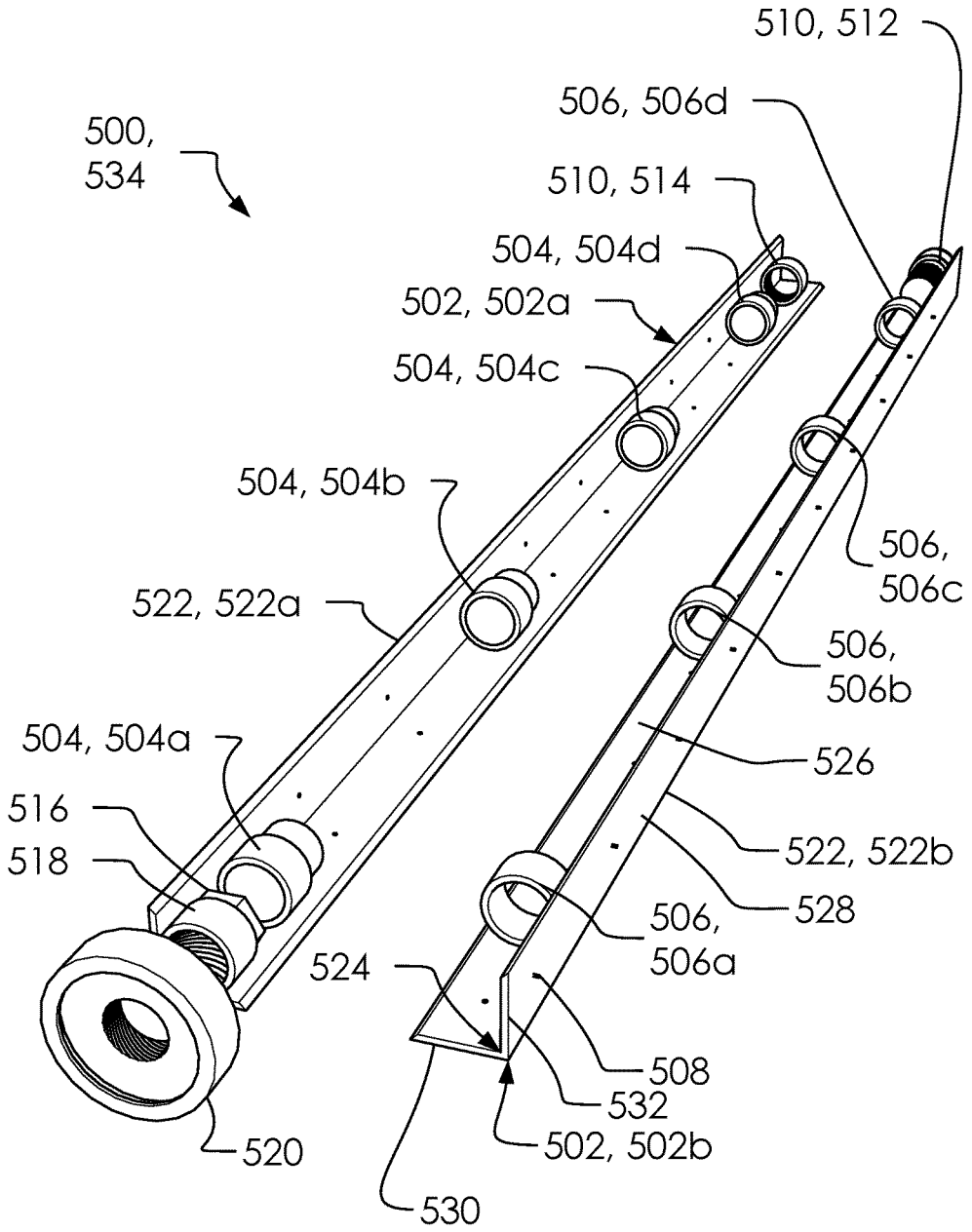
FIG. 5 illustrates a perspective overview view of a jig system 500 exploded.

FIG. 5 illustrates a perspective overview view of a jig system 500 exploded.

In one embodiment, said two halves 502 can comprise said first half 502*a* and said second half 502*b*.

In one embodiment, said one or more male portions 504 can comprise said first male portion 504*a*, said second male portion 504*b*, said third male portion 504*c* and said fourth male portion 504*d*.

In one embodiment, said one or more female sockets 506 can comprise said first female socket 506*a*, said second female socket 506*b*, said third female socket 506*c* and said fourth female socket 506*d*.

In one embodiment, said bracket mating system 510 can comprise said bolt 512 and said threaded sleeve 514.

In one embodiment, said jig system 500 can comprise said two halves 502, said one or more male portions 504, said one or more female sockets 506, said plurality of screws 508, said bracket mating system 510, said bolt 512, said threaded sleeve 514, said bolt 516, said sleeve 518, said jaw chuck ring 520, said angled irons 522 and said disassembled configuration 534.

In one embodiment, said angled irons 522 can comprise said first angled iron 522*a*, said second angled iron 522*b*, said bend 524, said inner sides 526, said outer sides 528, said first planar portion 530 and said second planar portion 532.

In one embodiment, said adjustment wheel 400 can comprise said bend 524, said inner sides 526 and said outer sides 528.

In one embodiment, a portion of said one or more male portions 504 can slide into a portion of said one or more female sockets 506 for securing said two halves 502 to one another.

Said two halves 502 can fit into one another to create a substantially rectangular object for affixing boards to its sides, as discussed below.

Said jaw chuck ring 520 can selectively attach to said bolt 516 and thereafter selectively attach to said head stock 302 of said lathe 300. Likewise, said bracket mating system 510 can selectively attach to said tail stock 306. Wherein, said jig system 500 can be rotateably attached to said lathe 300 for carving, as is known in the art.

Said two halves 502 can comprise a durable material such as stainless steel, aluminum or other suitable materials. Further, it can comprise an "L" shaped object being at a right angle with substantially identical sides. Said plurality of screws 508 can penetrate a portion of said two halves 502 for selectively affixing to boards.

Figures 6A, 6B:
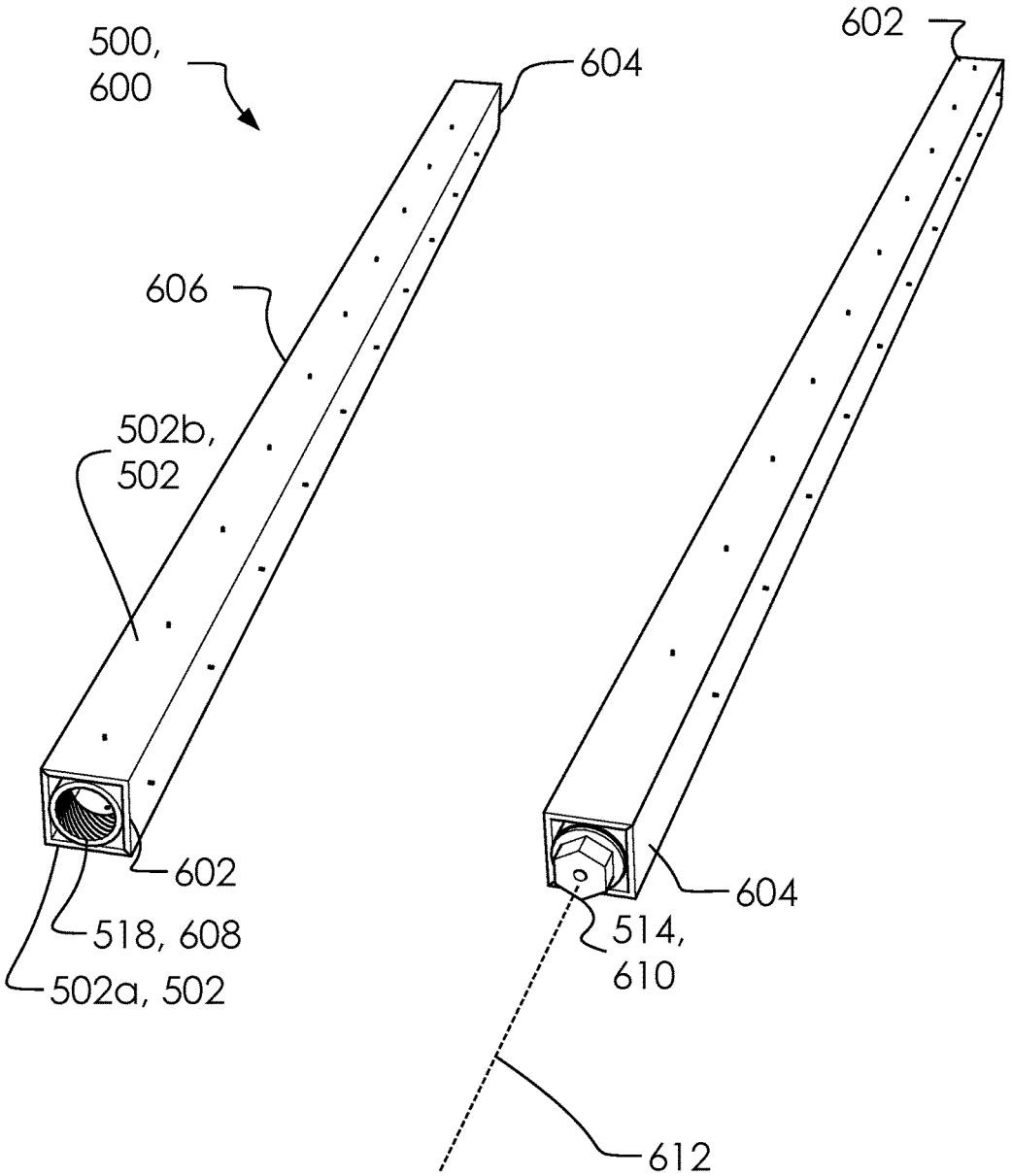
FIG. 6A illustrates a perspective first side view of an assembled configuration 600.
FIG. 6B illustrates a perspective second side view of an assembled configuration 600.

FIG. 6A illustrates a perspective first side view of an assembled configuration 600.

FIG. 6B illustrates a perspective second side view of an assembled configuration 600.

In one embodiment, said jig system 500 can comprise said first end 602, said second end 604, said outer body 606, said first lathe adapter assembly 608, said second lathe adapter assembly 610 and said central rotating axis 612.

Said sleeve 518 can be at said first end 602, and said threaded sleeve 514 can be at said second end 604. Said outer body 606 can comprise said two halves 502 being attached facing one another so as to create something like a square tubing having been cut at two of its edges.

Figure 7:
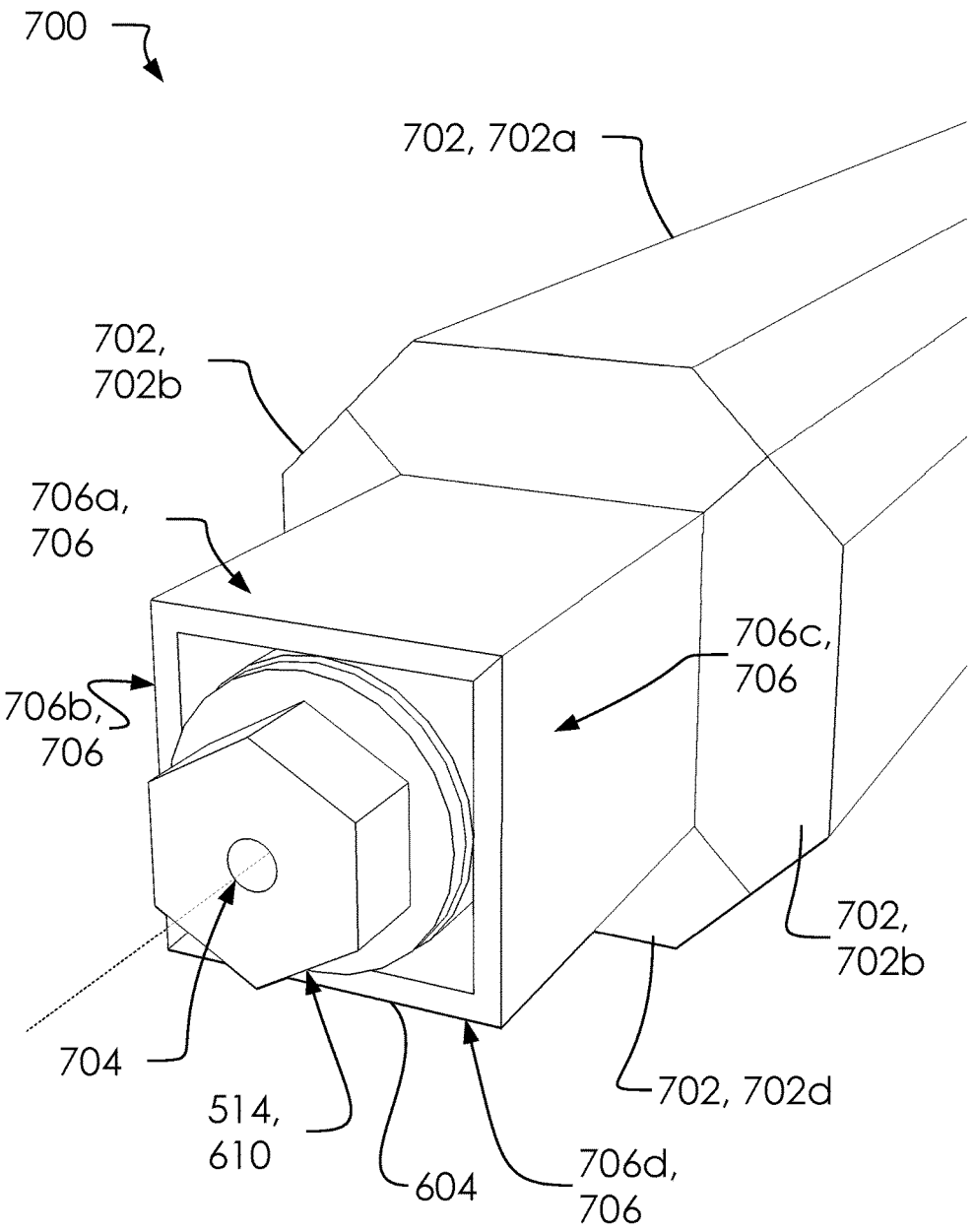
FIG. 7 illustrates a perspective first side view of a jig with boards 700.

FIG. 7 illustrates a perspective first side view of a jig with boards 700.

In one embodiment, said one or more uncut boards 702 can comprise said first uncut board 702*a*, said second uncut board 702*b*, said third uncut board 702*c* and said fourth uncut board 702*d*.

In one embodiment, said four sides 706 can comprise said top 706*a*, said first side 706*b*, said second side 706*c* and said bottom 706*d*.

In one embodiment, said threaded sleeve 514 can comprise said eye 704.

In one embodiment, said jig system 500 can comprise said four sides 706, said top 706*a*, said first side 706*b*, said second side 706*c* and said bottom 706*d*.

In one embodiment, said plurality of screws 508 can be used for affixing a portion of said one or more uncut boards 702 to said two halves 502.

Benefits of the improved system can comprise faster cuts in one pass, saved material and skipping of an adhesive step. For example, the system can attach smaller blocks to said jig system 500 with fasteners (such as said plurality of screws 508), and thereby skip building thick blocks of wood as with said one or more prior art steps 100.

The one or more uncut boards 702 then can be carved according to the desire of the manufacturer with said lathe 300.

Designs such as rope, fluted, beaded, custom images and the like are possible.

As shown, said eye 704 can be useful for receiving a portion of said tail stock 306. In one embodiment, said eye 704 can comprise a substantially round hole and said tail stock 306 can comprise a cone shaped tip that can selectively seat within said eye 704, as is known in the art.

In one embodiment, said threaded sleeve 514 can comprise a hex shaped bot pattern for rotating and adjusting said two halves 502 relative to one another, as described below.

Said one or more uncut boards 702 can each comprise regular lumber boards having been cut in a flattened hex pattern (as illustrated) so as to fit around said jig system 500, and encompass it on all of said four sides 706.

Figure 8:
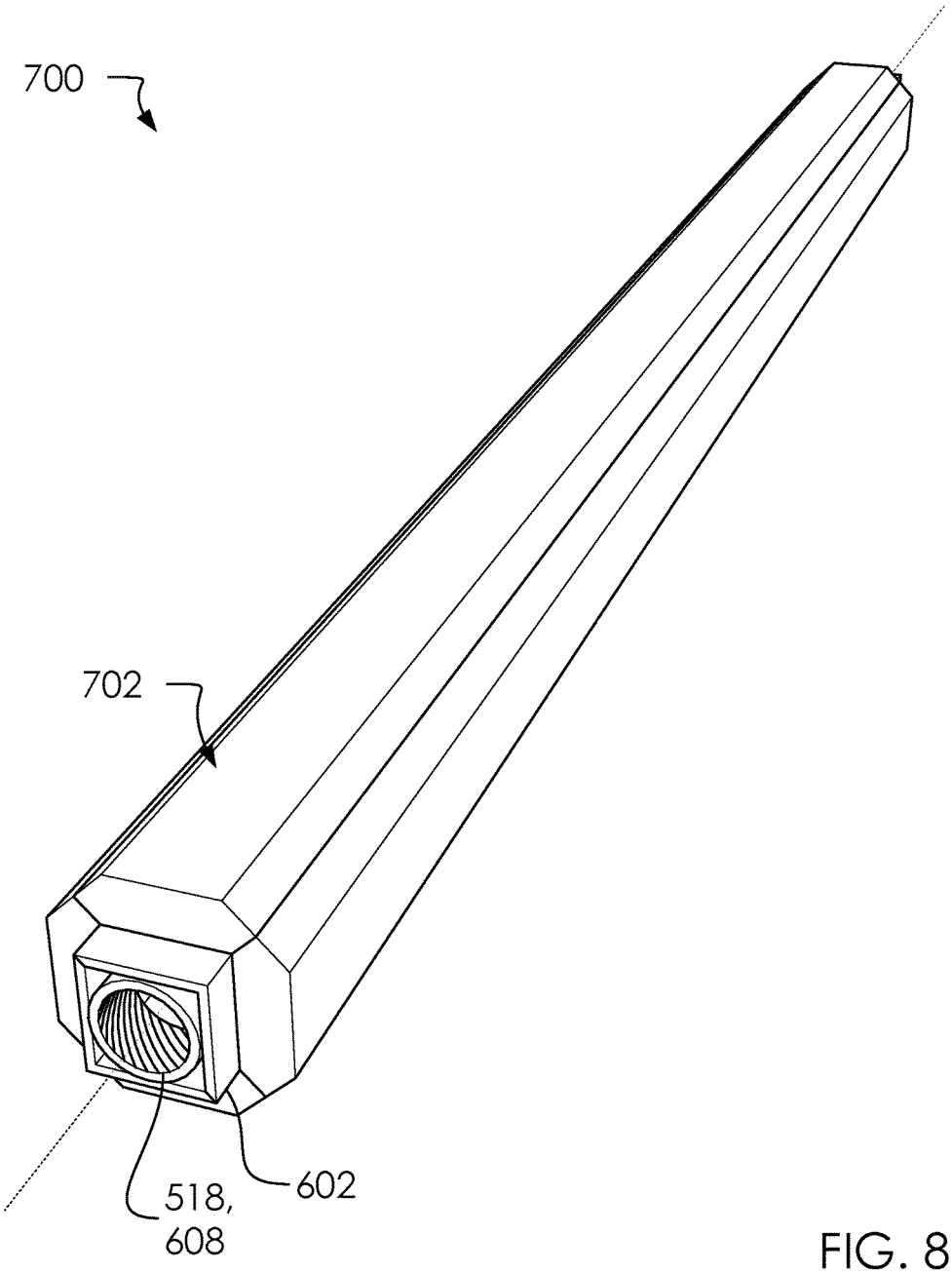
FIG. 8 illustrates a perspective overview view of a jig with boards 700.

FIG. 8 illustrates a perspective overview view of a jig with boards 700.

Figure 9:
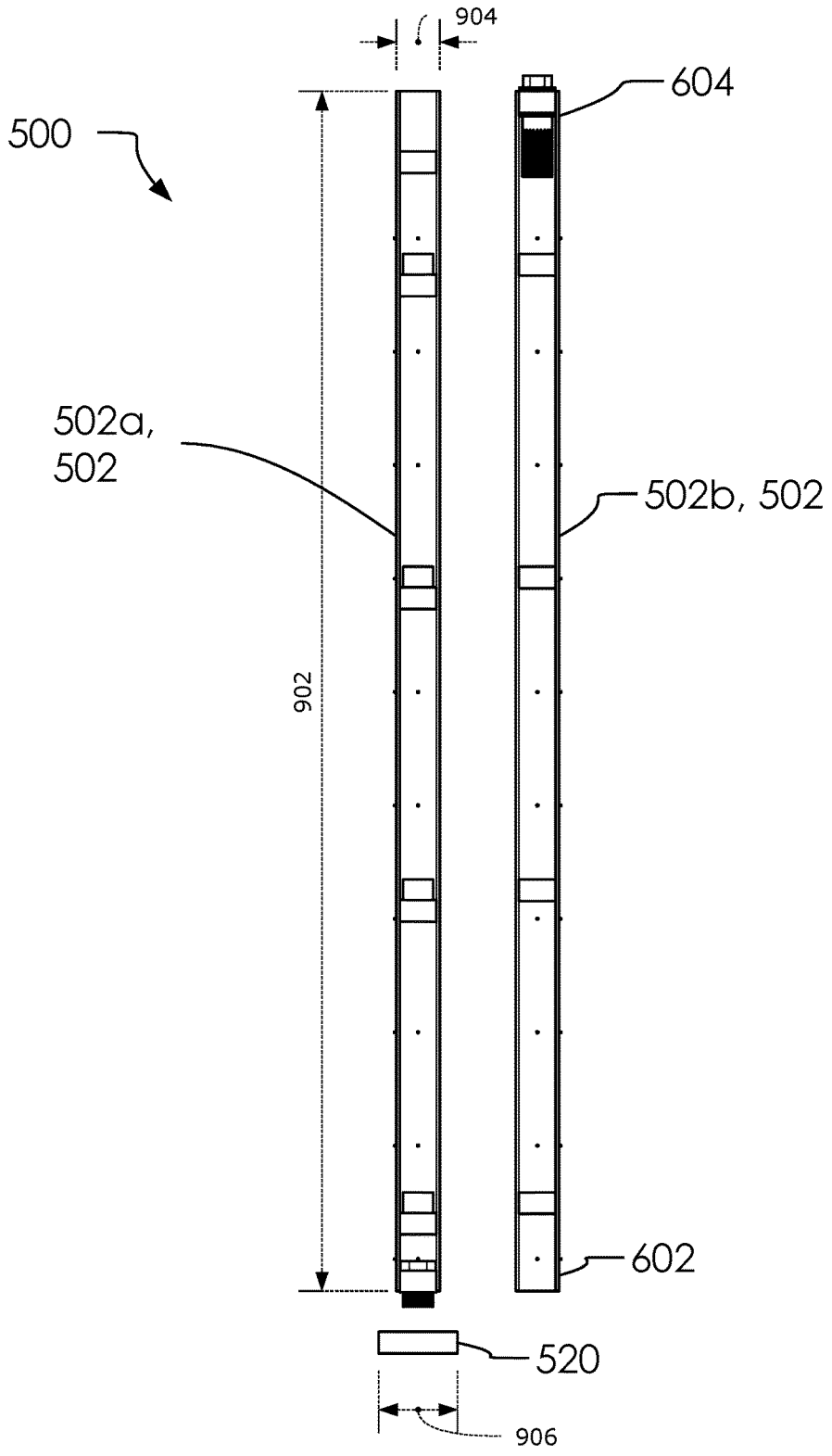
FIG. 9 illustrates an elevated top side view of a jig system 500.

FIG. 9 illustrates an elevated top side view of a jig system 500.

In one embodiment, said jaw chuck ring 520 can comprise said diameter 906.

In one embodiment, said jig system 500 can comprise said length 902, said width 904 and said diameter 906.

Figure 10:
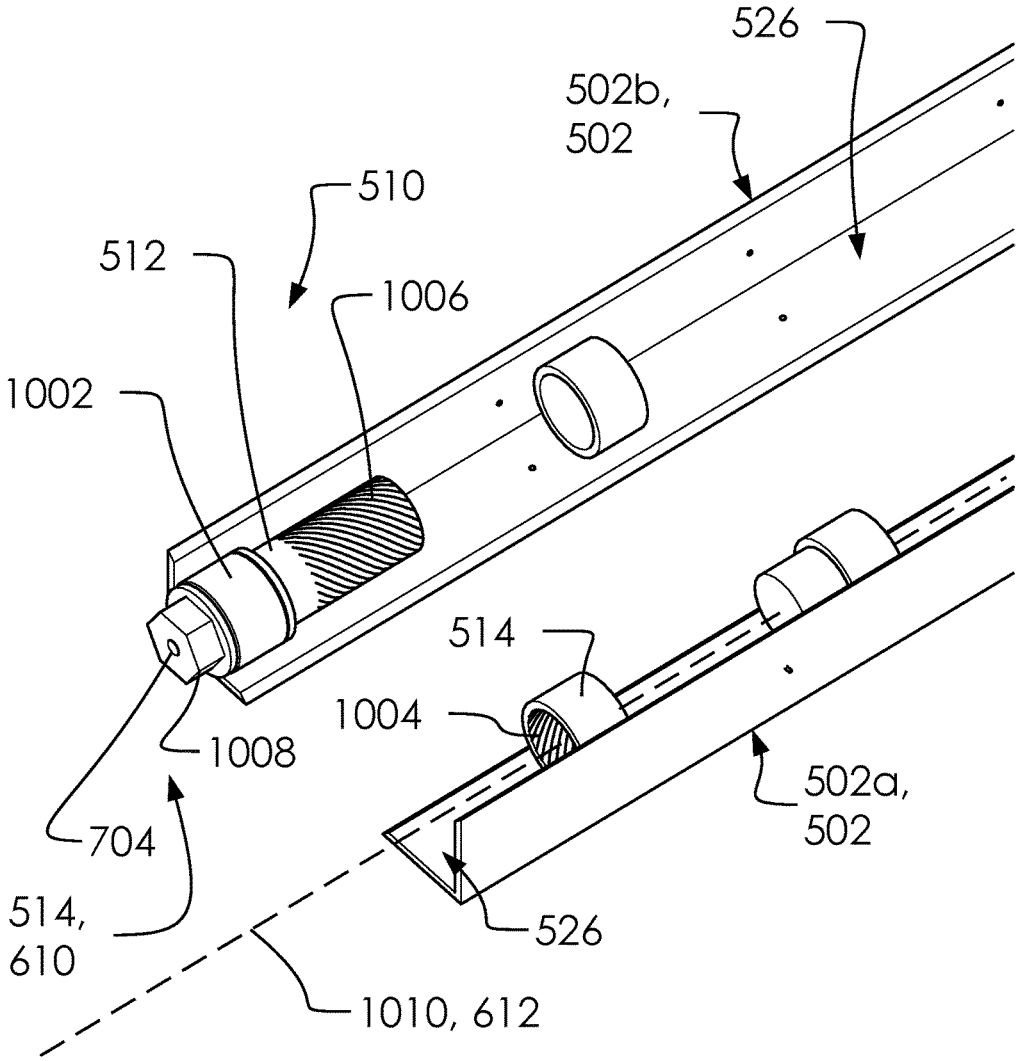
FIG. 10 illustrates a perspective first side view of a jig system 500 exploded.

FIG. 10 illustrates a perspective first side view of a jig system 500 exploded.

In one embodiment, said bracket mating system 510 can comprise said collar 1002, said female threading 1004, said male threading 1006 and said head 1008.

In one embodiment, said bolt 512 can comprise said male threading 1006 and said head 1008.

In one embodiment, said jig system 500 can comprise said collar 1002 and said center axis 1010.

In one embodiment, said bracket mating system 510 can be used for adjusting an attachment location of said first half 502*a* relative to said second half 502*b*. For example, in one embodiment, said two halves 502 can be selectively attached to one another by: aligning a portion of said one or more male portions 504 with said one or more female sockets 506; inserting said one or more male portions 504 into said one or more female sockets 506; inserting a portion of said bolt 512 into said threaded sleeve 514; turning said head 1008 so as to screw a portion of said male threading 1006 into a portion of said female threading 1004; selectively holding said both of said two halves 502 together with said one or more male portions 504, said one or more female sockets 506 and said bolt 512. Said bracket mating system 510 can be used to adjust said two halves 502 along said center axis 1010.

The process of attaching said two halves 502 together with said bracket mating system 510 is an advancement in the art. Previously, jigs needed to be attached by careful alignment, compression, adhesive and similar. Here, the jig prepares for woodturning by merely sliding together and turning a portion of said bolt 512.

Figure 11A:
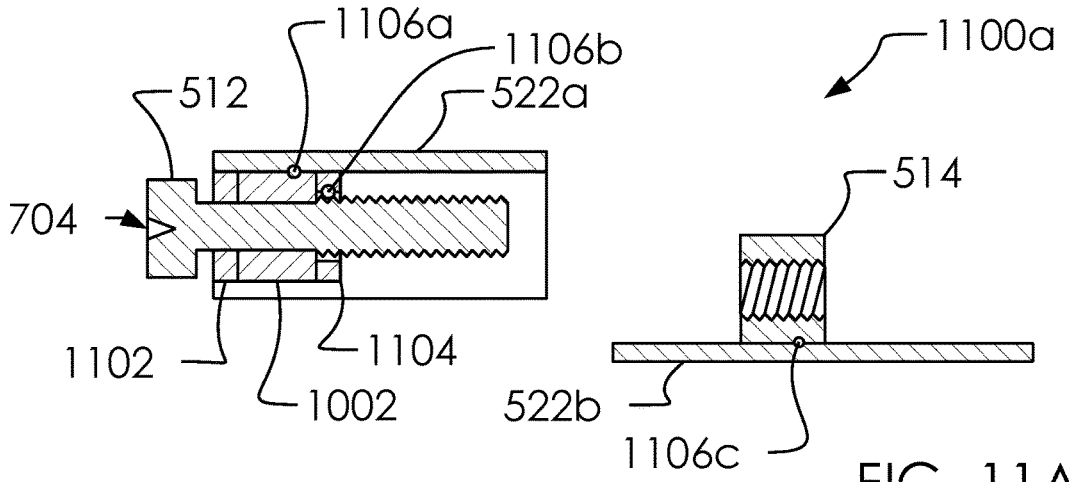
FIG. 11A illustrates an elevated front side view of a separated view 1100*a* with cross-section.

FIG. 11A illustrates an elevated front side view of a separated view 1100*a* with cross-section.

Figure 11B:
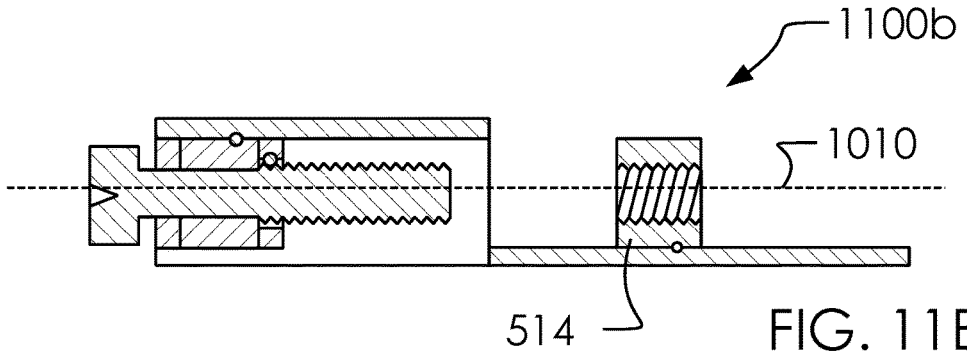
FIG. 11B illustrates an elevated front side view of an aligned view 1100*b* with cross-section.

FIG. 11B illustrates an elevated front side view of an aligned view 1100*b* with cross-section.

Figure 11C:
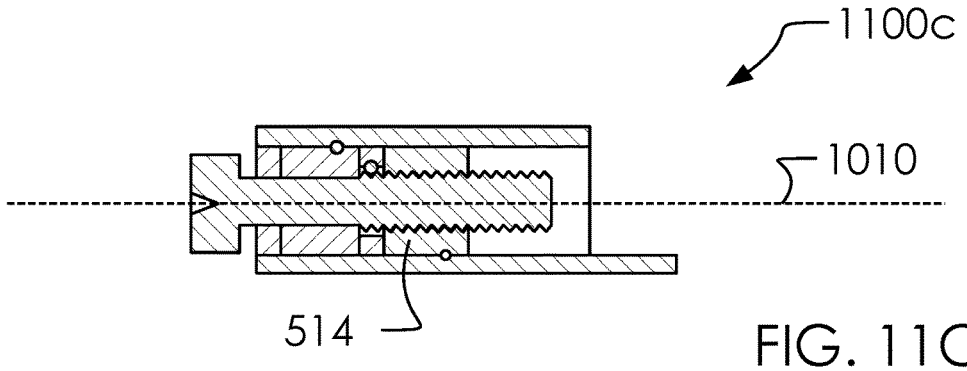
FIG. 11C illustrates an elevated front side view of an attached view 1100*c* with cross-section.

FIG. 11C illustrates an elevated front side view of an attached view 1100*c* with cross-section.

In one embodiment, said one or more welds 1106 can comprise said first weld 1106*a*, said second weld 1106*b* and said third weld 1106*c*.

In one embodiment, said bracket mating system 510 can comprise said first washer 1102, said second washer 1104 and said one or more welds 1106.

In one embodiment, said jig system 500 can comprise said second washer 1104 and said one or more welds 1106.

Here, said bracket mating system 510 is shown to be attaching together said two halves 502 in three steps (said separated view 1100*a*, said aligned view 1100*b*, and said attached view 1100*c*).

Note that said first weld 1106*a* holds said collar 1002 to said first angled iron 522*a* so that said bolt 512 remains attached thereto. Likewise, said second weld 1106*b* holds said second washer 1104 to said bolt 512. And finally, said third weld 1106*c* can hold said threaded sleeve 514 to said second angled iron 522*b*. Consequently, by turning said bolt 512, said bolt 512 is caused to screw into said threaded sleeve 514 and adjust a movement of said two halves 502 relative to one another along said center axis 1010.

Said first washer 1102 can comprise a lock washer or a normal washer.

Said collar 1002 can keep said bolt 512 located along said center axis 1010.

Figure 12:
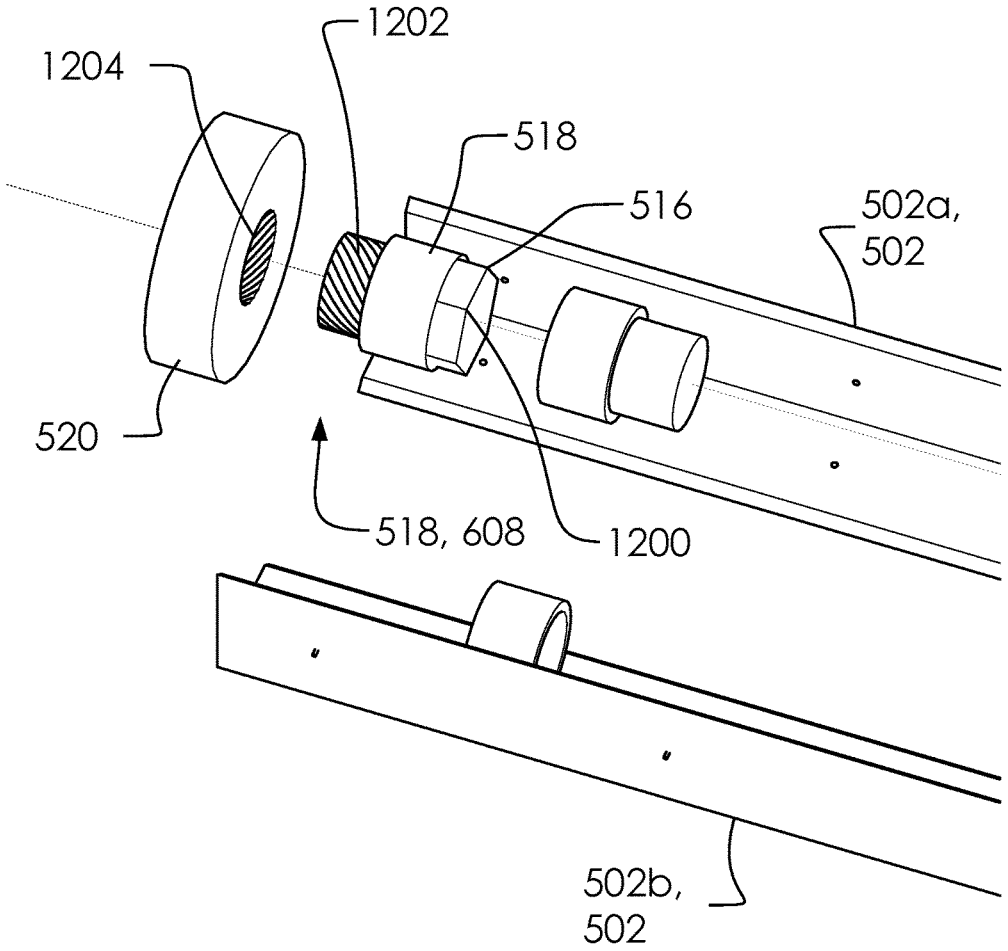
FIG. 12 illustrates a perspective first side view of a jig system 500.

FIG. 12 illustrates a perspective first side view of a jig system 500.

In one embodiment, said bolt 516 can comprise said head 1200 and said threading 1202.

In one embodiment, said jaw chuck ring 520 can comprise said inner threading 1204.

In one embodiment, said bolt 516 can selectively mate with said jaw chuck ring 520. In one embodiment, said jaw chuck ring 520 can selectively mate with a portion of said lathe 300.

Figure 13A:
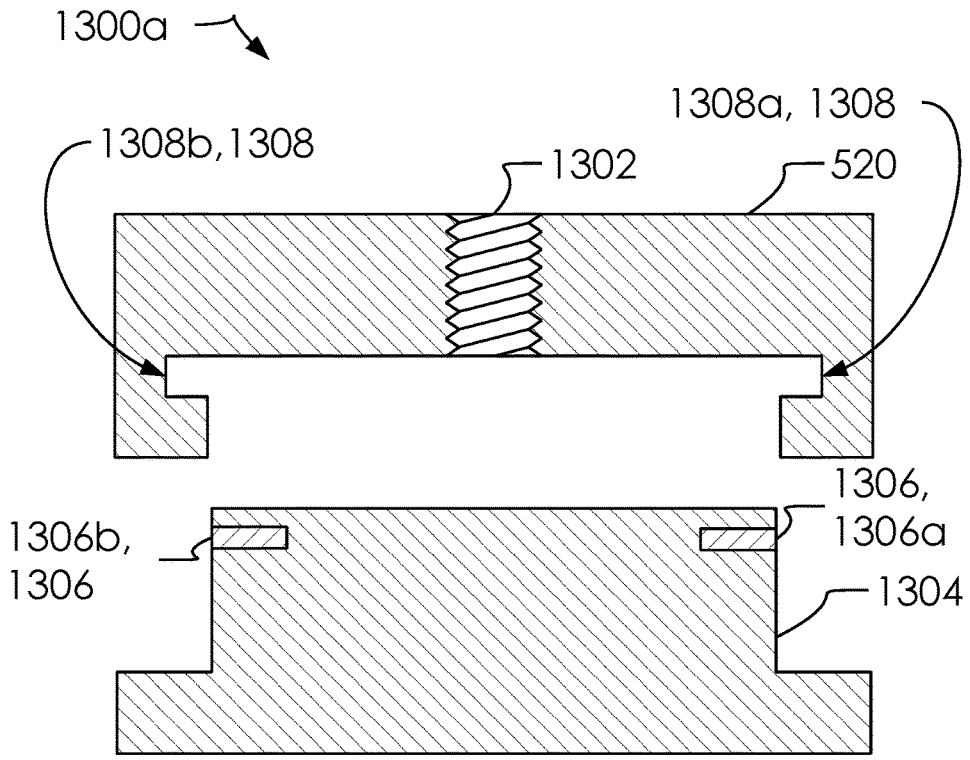
FIG. 13A illustrates an elevated top side view of a detached view 1300*a* with cross-section.

FIG. 13A illustrates an elevated top side view of a detached view 1300*a* with cross-section.

Figure 13B:
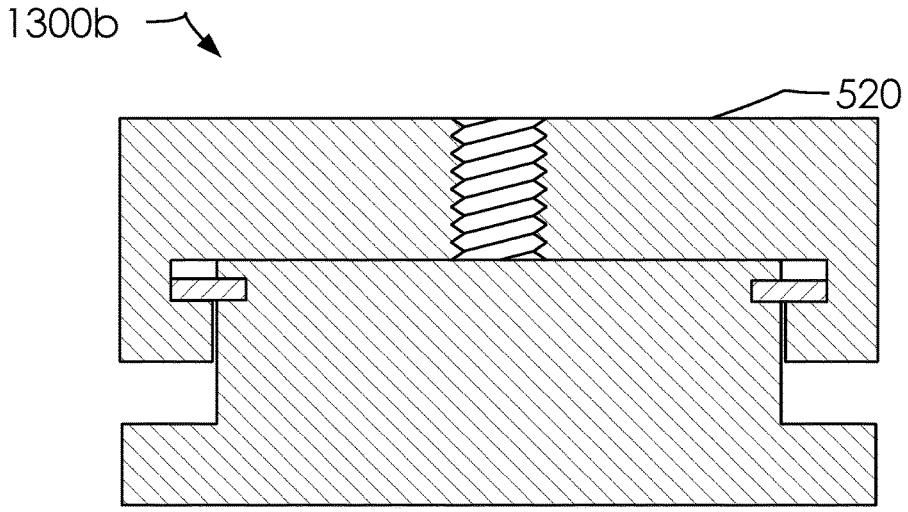
FIG. 13B illustrates an elevated top side view of an attached view 1300*b* with cross-section.

FIG. 13B illustrates an elevated top side view of an attached view 1300*b* with cross-section.

In one embodiment, said jaw chuck 1304 can comprise said jaw chuck 1304 and said one or more jaws 1306.

In one embodiment, said one or more jaws 1306 can comprise said first jaw 1306*a* and said second jaw 1306*b*.

In one embodiment, said one or more jaw lips 1308 can comprise said first jaw lip 1308*a* and said second jaw lip 1308*b*.

In one embodiment, said lathe 300 can comprise said jaw chuck 1304.

In one embodiment, said jaw chuck ring 520 can comprise said threaded socket 1302 and said one or more jaw lips 1308.

In one embodiment, said jig system 500 can comprise said threaded socket 1302 and said jaw chuck 1304.

In one embodiment, a portion of said jaw chuck 1304 can selectively mate with a portion of said jaw chuck ring 520 by: retracting said one or more jaws 1306 into said jaw chuck 1304; aligning and inserting a portion of said jaw chuck 1304 with said jaw chuck ring 520; extending said one or more jaws 1306 into said one or more jaw lips 1308; and holding said jaw chuck ring 520 and said jaw chuck 1304 together.

Said threaded socket 1302 can receive a portion of said bolt 516, as is known in the art.

Figure 14A:
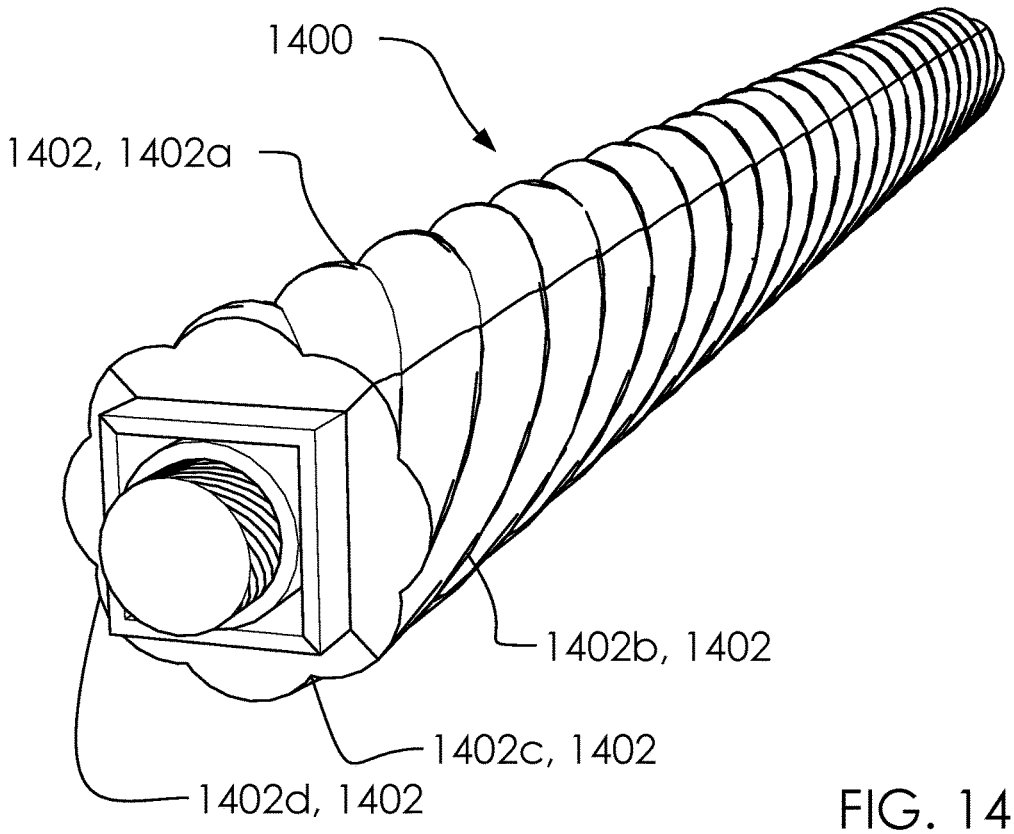
FIG. 14A illustrates a perspective overview view of a jig with cut boards 1400.

FIG. 14A illustrates a perspective overview view of a jig with cut boards 1400.

Figure 14B:
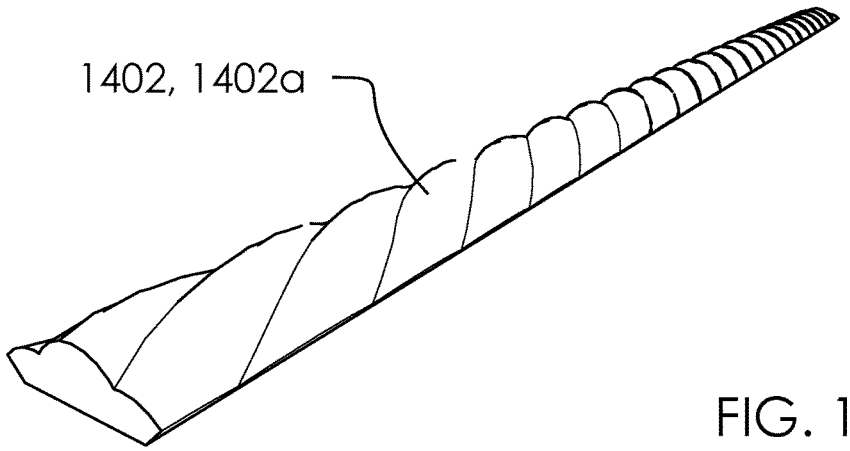
FIG. 14B illustrates a perspective overview view of a one or more cut boards 1402.

FIG. 14B illustrates a perspective overview view of a one or more cut boards 1402.

In one embodiment, said one or more cut boards 1402 can comprise said first cut board 1402*a*, said second cut board 1402*b*, said third cut board 1402*c* and said fourth cut board 1402*d*.

Here, is a great achievement of said jig system 500. Namely, the creation of said one or more cut boards 1402 without wasting said one or more wasted portions 108. Said jig with cut boards 1400 can comprise one embodiment of said one or more uncut boards 702 after being cut in said lathe 300. Here, each among said one or more cut boards 1402 are superior to said one or more trimmed uncut blocks 106 in that they require no adhesive, minimize wasted time and material, and are created more quickly that the prior art.

Said jig system 500 is designed to release jig with cut boards 1400 from said jig system 500 by: unscrewing said bolt 512 to release said two halves 502 from one another; removing said two halves 502 from one another; unscrewing said plurality of screws 508 from the underside of said one or more cut boards 1402; and removing said one or more cut boards 1402 from said two halves 502. Hereafter, a user of said jig system 500 can repeat the steps so as to stockpile said one or more cut boards 1402 or otherwise meet the needs of a current project.

Figure 15A:
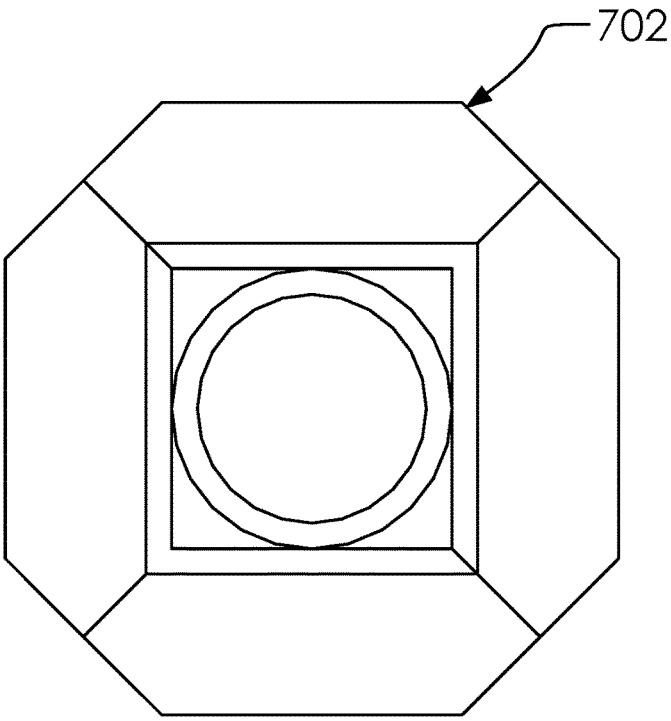
FIG. 15A illustrates an elevated first side view of a jig with boards 700.

FIG. 15A illustrates an elevated first side view of a jig with boards 700.

Figure 15B:
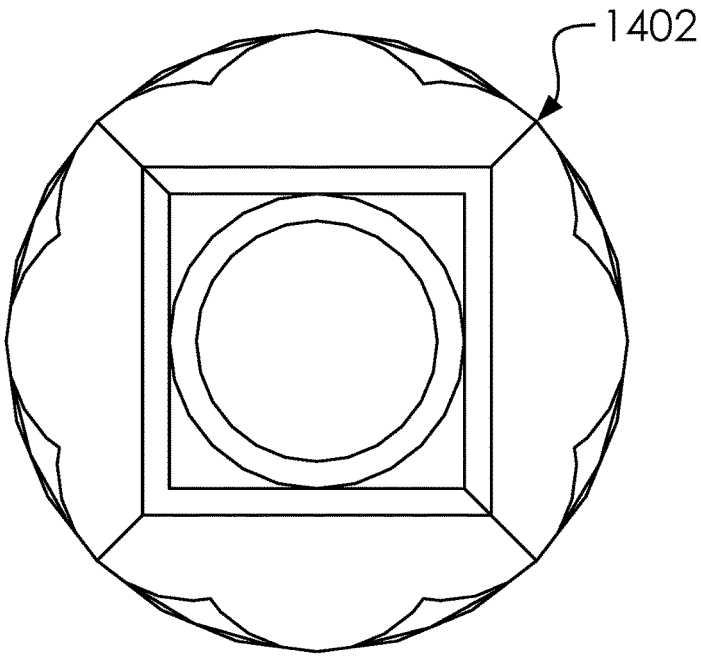
FIG. 15B illustrates an elevated first side view of a jig with cut boards 1400.

FIG. 15B illustrates an elevated first side view of a jig with cut boards 1400.

These figures are included to show the efficiency of said jig system 500 in conjunction with said one or more uncut boards 702 and said lathe 300, wherein very little material is wasted.

Figure 16A:
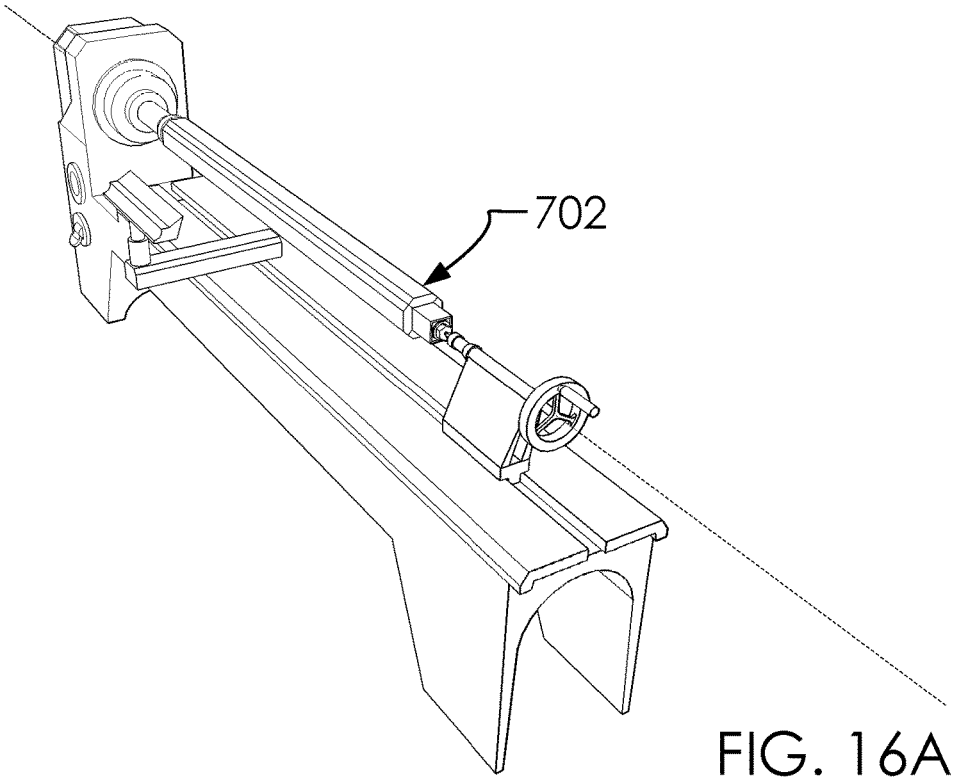
FIG. 16A illustrates a perspective overview view of a one or more uncut boards 702.

FIG. 16A illustrates a perspective overview view of a one or more uncut boards 702.

Figure 16B:
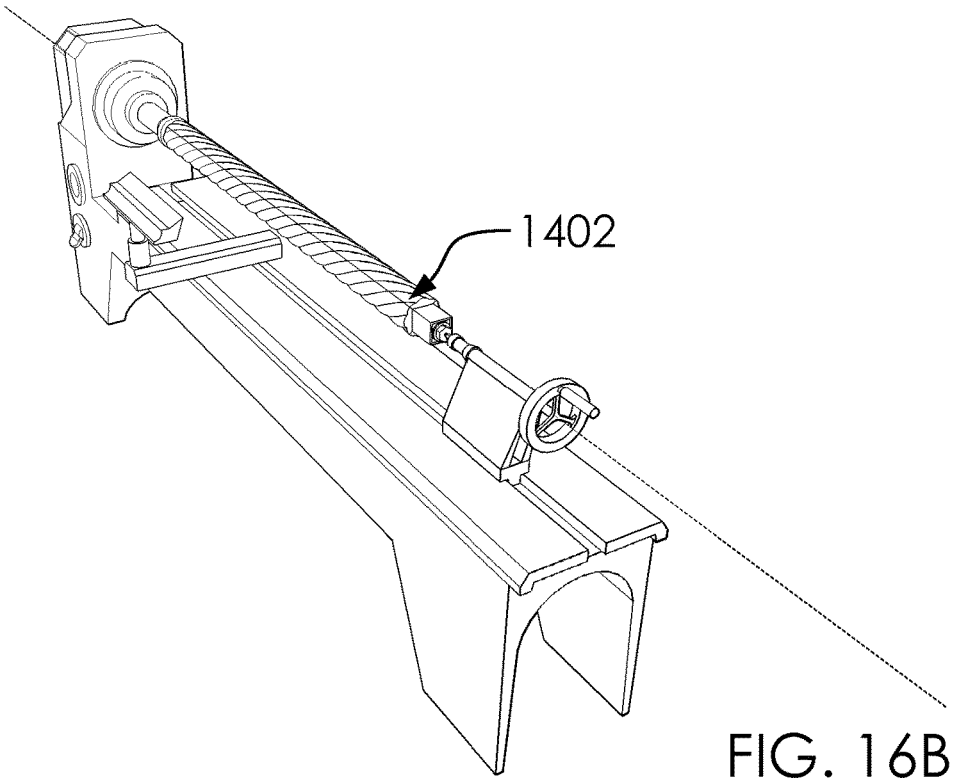
FIG. 16B illustrates a perspective overview view of a one or more cut boards 1402.

FIG. 16B illustrates a perspective overview view of a one or more cut boards 1402

The following sentences are constructed from the claims (below) and represent the preferred embodiments of this disclosure.

A jig system 500 for trimming of a one or more uncut boards 702. Said jig system 500 comprises a two halves 502, a bracket mating system 510, a one or more male portions 504, a one or more female sockets 506, a first end 602, a second end 604, a first lathe adapter assembly 608, and a second lathe adapter assembly 610. Said two halves 502 comprise a first half 502*a* and a second half 502*b*. Said two halves 502 are configured to selectively mate with one another. Said two halves 502 comprises an assembled configuration 600 and a disassembled configuration 534. Said assembled configuration 600 comprises said two halves 502 mated with one another. Said disassembled configuration 534 comprise said two halves 502 detached from one another. Said two halves 502 comprise an angled irons 522 having a substantially L-shape. Said two halves 502 comprise a bend 524, an inner sides 526, an outer sides 528, a first planar portion 530 and a second planar portion 532. Said first planar portion 530 joins said second planar portion 532 at said outer sides 528. Said inner sides 526 comprise faces of said first planar portion 530 and said second planar portion 532 proximate said bend 524. Said outer sides 528 comprise faces of said first planar portion 530 and said second planar portion 532 opposite said inner sides 526. Said first half 502*a* comprise said one or more male portions 504 mounted to said inner sides 526. Said second half 502*b* comprise said one or more female sockets 506 mounted to said inner sides 526. Said outer sides 528 is configured to selectively hold said one or more uncut boards 702. Said jig system 500 is configured to selectively attach to a lathe 300 having a head stock 302 and a tail stock 306. Said jig system 500 comprises said first lathe adapter assembly 608 at said first end 602 and said second lathe adapter assembly 610 at said second end 604. Said first lathe adapter assembly 608 selectively attaches to said head stock 302 of said lathe 300 and said second lathe adapter assembly 610 selectively attaches to said tail stock 306 of said lathe 300.

Said first lathe adapter assembly 608 comprises a bolt 512 having an eye 704 at said second end 604 of said jig system 500. Said first lathe adapter assembly 608 comprises a bolt 516 in a sleeve 518. Said sleeve 518 is attached to said inner sides 526 of said first half 502*a*. Said first lathe adapter assembly 608 further comprises a jaw chuck ring 520. Said bolt 512 comprises a head 1200 and a threading 1202. Said bolt 512 is rotateably held within a portion of said sleeve 518. Said jaw chuck ring 520 comprises an inner threading 1204. Said inner threading 1204 of said jaw chuck ring 520 selectively attaches to said threading 1202 of said bolt 516.

Said lathe 300 comprises a jaw chuck 1304. Said jaw chuck 1304 comprises a one or more jaws 1306. Said jaw chuck ring 520 comprise a one or more jaw lips 1308. Said jaw chuck ring 520 selectively attaches to said jaw chuck 1304 by: sliding a portion of said jaw chuck 1304 into a portion of said jaw chuck ring 520, expanding said one or more jaws 1306 into a portion of said one or more jaw lips 1308, holding said jaw chuck ring 520 with said one or more jaws 1306.

Assembling said jig system 500 into said disassembled configuration 534 comprises aligning a portion of said one or more male portions 504 with a portion of said one or more female sockets 506, sliding a portion of said one or more male portions 504 into said one or more female sockets 506, and securing said first half 502*a* to said second half 502*b*.

Said first half 502*a* comprises a threaded sleeve 514. Said second half 502*b* comprises a bolt 512. Said bolt 512 comprises a male threading 1006 and said threaded sleeve 514 comprises a female threading 1004. Said two halves 502 are configured to selectively attach to one another by aligning a portion of said bolt 512 with said threaded sleeve 514, and screwing a portion of said male threading 1006 into said female threading 1004.

Said two halves 502 are configured to adjust relative positions relative to one another along a central rotating axis 612 by screwing and unscrewing portions of said male threading 1006 from said female threading 1004.

Said bolt 512 comprises a head 1008, and said male threading 1006. Said bolt 512 rotates freely within a collar 1002. Said collar 1002 is attached to said inner sides 526 of said second half 502*b*. Said threaded sleeve 514 is attached to said inner sides 526 of said first half 502*a*.

With said jig system 500 in said assembled configuration 600, said two halves 502 comprise a square shape having a four sides 706. Said one or more uncut boards 702 selectively attach to said four sides 706. Said jig system 500 and said lathe 300 are configured to trim said one or more uncut boards 702 into a one or more cut boards 1402 by attaching said one or more uncut boards 702 to said four sides 706, rotating said jig system 500 on said lathe 300, and carving a portion of said one or more uncut boards 702 into said one or more cut boards 1402.

Said one or more uncut boards 702 selectively attach to an outer body 606 of said jig system 500. Said outer body 606 comprises said outer sides 528 of said two halves 502 in said assembled configuration 600.

Said second lathe adapter assembly 610 comprises an eye 704. Said eye 704 selectively attaches to said tail stock 306 of said lathe 300. A jig system 500 for trimming of a one or more uncut boards 702.

A first lathe adapter assembly 608 comprises a bolt 512 having an eye 704 at a second end 604 of said jig system 500. Said first lathe adapter assembly 608 comprises a bolt 516 in a sleeve 518. Said sleeve 518 is attached to an inner sides 526 of a first half 502*a*. Said first lathe adapter assembly 608 further comprises a jaw chuck ring 520. Said bolt 512 comprises a head 1200 and a threading 1202. Said bolt 512 is rotateably held within a portion of said sleeve 518. Said jaw chuck ring 520 comprises an inner threading 1204. Said inner threading 1204 of said jaw chuck ring 520 selectively attaches to said threading 1202 of said bolt 516. A lathe 300 comprises a jaw chuck 1304. Said jaw chuck 1304 comprises a one or more jaws 1306. Said jaw chuck ring 520 comprise a one or more jaw lips 1308. Said jaw chuck ring 520 selectively attaches to said jaw chuck 1304 by: sliding a portion of said jaw chuck 1304 into a portion of said jaw chuck ring 520, expanding said one or more jaws 1306 into a portion of said one or more jaw lips 1308, holding said jaw chuck ring 520 with said one or more jaws 1306. Assembling said jig system 500 into a disassembled configuration 534 comprises aligning a portion of a one or more male portions 504 with a portion of a one or more female sockets 506, sliding a portion of said one or more male portions 504 into said one or more female sockets 506, and securing said first half 502*a* to a second half 502*b*.

A method of using a jig system 500 to trim a one or more uncut boards 702 comprising the following. Attaching said one or more uncut boards 702 to said jig system 500. Rotating said jig system 500 on a lathe 300. Trimming said one or more uncut boards 702 into a one or more cut boards 1402. A first lathe adapter assembly 608 comprises a bolt 512 having an eye 704 at a second end 604 of said jig system 500. Said first lathe adapter assembly 608 comprises a bolt 516 in a sleeve 518. Said sleeve 518 is attached to an inner sides 526 of a first half 502*a*. Said first lathe adapter assembly 608 further comprises a jaw chuck ring 520. Said bolt 512 comprises a head 1200 and a threading 1202. Said bolt 512 is rotateably held within a portion of said sleeve 518. Said jaw chuck ring 520 comprises an inner threading 1204. Said inner threading 1204 of said jaw chuck ring 520 selectively attaches to said threading 1202 of said bolt 516. Said lathe 300 comprises a jaw chuck 1304. Said jaw chuck 1304 comprises a one or more jaws 1306. Said jaw chuck ring 520 comprise a one or more jaw lips 1308. Said jaw chuck ring 520 selectively attaches to said jaw chuck 1304 by: sliding a portion of said jaw chuck 1304 into a portion of said jaw chuck ring 520, expanding said one or more jaws 1306 into a portion of said one or more jaw lips 1308, holding said jaw chuck ring 520 with said one or more jaws 1306. Assembling said jig system 500 into a disassembled configuration 534 comprises aligning a portion of a one or more male portions 504 with a portion of a one or more female sockets 506, sliding a portion of said one or more male portions 504 into said one or more female sockets 506, and securing said first half 502*a* to a second half 502*b*.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A jig system for trimming of a one or more uncut boards, wherein:

said jig system comprises a two halves, a bracket mating system, a one or more male portions, a one or more female sockets, a first end, a second end, a first lathe adapter assembly, and a second lathe adapter assembly;

said two halves comprise a first half and a second half;

said two halves are configured to selectively mate with one another;

said two halves comprises an assembled configuration and a disassembled configuration;

said assembled configuration comprises said two halves mated with one another;

said disassembled configuration comprise said two halves detached from one another;

said two halves comprise an angled irons having a substantially L-shape;

said two halves comprise a bend, an inner sides, an outer sides, a first planar portion and a second planar portion;

said first planar portion joins said second planar portion at said outer sides;

said inner sides comprise faces of said first planar portion and said second planar portion proximate said bend;

said outer sides comprise faces of said first planar portion and said second planar portion opposite said inner sides;

said first half comprise said one or more male portions mounted to said inner sides;

said second half comprise said one or more female sockets mounted to said inner sides;

said outer sides is configured to selectively hold said one or more uncut boards;

said jig system is configured to selectively attach to a lathe having a head stock and a tail stock;

said jig system comprises said first lathe adapter assembly at said first end and said second lathe adapter assembly at said second end; and said first lathe adapter assembly selectively attaches to said head stock of said lathe and said second lathe adapter assembly selectively attaches to said tail stock of said lathe.

2. The jig system from claim 1, wherein:

said first lathe adapter assembly comprises a bolt having an eye at said second end of said jig system;

said first lathe adapter assembly comprises a bolt in a sleeve;

said sleeve is attached to said inner sides of said first half;

said first lathe adapter assembly further comprises a jaw chuck ring;

said bolt comprises a head and a threading;

said bolt is rotateably held within a portion of said sleeve;

said jaw chuck ring comprises an inner threading; and said inner threading of said jaw chuck ring selectively attaches to said threading of said bolt.

3. The jig system from claim 2, wherein:

said lathe comprises a jaw chuck;

said jaw chuck comprises a one or more jaws;
said jaw chuck ring comprise a one or more jaw lips; and
said jaw chuck ring selectively attaches to said jaw chuck by:
sliding a portion of said jaw chuck into a portion of said jaw chuck ring,
expanding said one or more jaws into a portion of said one or more jaw lips,
holding said jaw chuck ring with said one or more jaws.

4. The jig system from claim 1, wherein:
assembling said jig system into said disassembled configuration comprises;
aligning a portion of said one or more male portions with a portion of said one or more female sockets,
sliding a portion of said one or more male portions into said one or more female sockets, and
securing said first half to said second half.

5. The jig system from claim 4, wherein:
said first half comprises a threaded sleeve;
said second half comprises a bolt;
said bolt comprises a male threading and said threaded sleeve comprises a female threading; and
said two halves are configured to selectively attach to one another by
aligning a portion of said bolt with said threaded sleeve, and
screwing a portion of said male threading into said female threading.

6. The jig system from claim 5, wherein:
said two halves are configured to adjust relative positions relative to one another along a central rotating axis by screwing and unscrewing portions of said male threading from said female threading.

7. The jig system from claim 5, wherein:
said bolt comprises a head, and said male threading;
said bolt rotates freely within a collar;
said collar is attached to said inner sides of said second half; and
said threaded sleeve is attached to said inner sides of said first half.

8. The jig system from claim 1, wherein:
with said jig system in said assembled configuration, said two halves comprise a square shape having a four sides;
said one or more uncut boards selectively attach to said four sides; and
said jig system and said lathe are configured to trim said one or more uncut boards into a one or more cut boards by
attaching said one or more uncut boards to said four sides,
rotating said jig system on said lathe, and
carving a portion of said one or more uncut boards into said one or more cut boards.

9. The jig system from claim 1, wherein:
said one or more uncut boards selectively attach to an outer body of said jig system; and
said outer body comprises said outer sides of said two halves in said assembled configuration.

10. The jig system from claim 1, wherein:
said second lathe adapter assembly comprises an eye; and
said eye selectively attaches to said tail stock of said lathe.

11. A jig system for trimming of a one or more uncut boards, wherein:
a first lathe adapter assembly comprises a bolt having an eye at a second end of said jig system;
said first lathe adapter assembly comprises a bolt in a sleeve;
said sleeve is attached to an inner sides of a first half;
said first lathe adapter assembly further comprises a jaw chuck ring;
said bolt comprises a head and a threading;
said bolt is rotateably held within a portion of said sleeve;
said jaw chuck ring comprises an inner threading;
said inner threading of said jaw chuck ring selectively attaches to said threading of said bolt;
a lathe comprises a jaw chuck;
said jaw chuck comprises a one or more jaws;
said jaw chuck ring comprise a one or more jaw lips;
said jaw chuck ring selectively attaches to said jaw chuck by:
sliding a portion of said jaw chuck into a portion of said jaw chuck ring,
expanding said one or more jaws into a portion of said one or more jaw lips,
holding said jaw chuck ring with said one or more jaws; and
assembling said jig system into a disassembled configuration comprises
aligning a portion of a one or more male portions with a portion of a one or more female sockets,
sliding a portion of said one or more male portions into said one or more female sockets, and
securing said first half to a second half.

12. A method of using a jig system to trim a one or more uncut boards comprising:
attaching said one or more uncut boards to said jig system;
rotating said jig system on a lathe;
trimming said one or more uncut boards into a one or more cut boards; wherein;
a first lathe adapter assembly comprises a bolt having an eye at a second end of said jig system;
said first lathe adapter assembly comprises a bolt in a sleeve;
said sleeve is attached to an inner sides of a first half;
said first lathe adapter assembly further comprises a jaw chuck ring;
said bolt comprises a head and a threading;
said bolt is rotateably held within a portion of said sleeve;
said jaw chuck ring comprises an inner threading;
said inner threading of said jaw chuck ring selectively attaches to said threading of said bolt;
said lathe comprises a jaw chuck;
said jaw chuck comprises a one or more jaws;
said jaw chuck ring comprise a one or more jaw lips;
said jaw chuck ring selectively attaches to said jaw chuck by:
sliding a portion of said jaw chuck into a portion of said jaw chuck ring,
expanding said one or more jaws into a portion of said one or more jaw lips,
holding said jaw chuck ring with said one or more jaws; and
assembling said jig system into a disassembled configuration comprises
aligning a portion of a one or more male portions with a portion of a one or more female sockets,
sliding a portion of said one or more male portions into said one or more female sockets, and
securing said first half to a second half.

* * * * *